US009256183B2

(12) United States Patent
Ohkubo et al.

(10) Patent No.: US 9,256,183 B2
(45) Date of Patent: Feb. 9, 2016

(54) IMAGE FORMING APPARATUS THAT ELECTRICALLY GROUNDS THE SHEET CASSETTE UPON WITHDRAWAL OF THE SHEET CASSETTE

(71) Applicant: CANON KABUSHIKI KAISHA, Tokyo (JP)

(72) Inventors: Takateru Ohkubo, Susono (JP); Keita Nakajima, Suntou-gun (JP); Kentarou Tomoe, Susono (JP); Akira Matsushima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/325,462

(22) Filed: Jul. 8, 2014

(65) Prior Publication Data

US 2015/0016856 A1 Jan. 15, 2015

(30) Foreign Application Priority Data

Jul. 12, 2013 (JP) ..... 2013-146647

(51) Int. Cl.
*G03G 15/00* (2006.01)

(52) U.S. Cl.
CPC ..... *G03G 15/6505* (2013.01); *G03G 15/6502* (2013.01); *B65H 2301/5133* (2013.01); *B65H 2405/10* (2013.01); *B65H 2515/716* (2013.01); *B65H 2601/273* (2013.01); *G03G 2215/00383* (2013.01)

(58) Field of Classification Search
CPC ..... B65H 2405/10; B65H 2301/5133; B65H 2515/716; B65H 2601/273; B65H 2401/211; B65H 2401/212
See application file for complete search history.

(56) References Cited

U.S. PATENT DOCUMENTS

| | | | | |
|---|---|---|---|---|
| 5,456,456 | A * | 10/1995 | Abe et al. | 271/10.09 |
| 6,643,480 | B2 | 11/2003 | Kuwata et al. | |
| 6,871,848 | B2 | 3/2005 | Matsushima et al. | |
| 7,764,898 | B2 * | 7/2010 | Kobayashi | 399/90 |
| 7,971,868 | B2 | 7/2011 | Matsushima et al. | |
| 8,302,956 | B2 | 11/2012 | Matsushima et al. | |
| 8,714,543 | B2 | 5/2014 | Matsushima et al. | |
| 8,783,677 | B2 | 7/2014 | Matsushima et al. | |
| 2012/0321332 | A1 | 12/2012 | Yanagi et al. | |

FOREIGN PATENT DOCUMENTS

| | | | |
|---|---|---|---|
| CN | 102830597 | A | 12/2012 |
| JP | 11-157686 | A | 6/1999 |
| JP | 2007-230724 | A | 9/2007 |
| JP | 2013-003402 | A | 1/2013 |
| KR | 20120139584 | A | 12/2012 |

OTHER PUBLICATIONS

European Search Report issued in counterpart European Patent Application No. 14176486.0 dated Nov. 13, 2014.

* cited by examiner

*Primary Examiner* — Justin Olamit
(74) *Attorney, Agent, or Firm* — Fitzpatrick, Cella, Harper & Scinto

(57) ABSTRACT

A sheet storing portion is maintained in a state in which a sheet stacking portion on which sheets are stacked is electrically insulated, when the sheet storing portion is contained in a containing portion of an image forming apparatus body at the time of formation of an image. The sheet stacking portion is switched from the insulation state to a grounding state in which the sheet stacking portion is grounded through a ground portion by a switching portion through an operation of drawing the sheet storing portion.

8 Claims, 6 Drawing Sheets

IMAGE FORMING APPARATUS THAT ELECTRICALLY GROUNDS THE SHEET CASSETTE UPON WITHDRAWAL OF THE SHEET CASSETTE

BACKGROUND OF THE INVENTION

1. Field of the Invention

The present invention relates to an image forming apparatus.

2. Description of the Related Art

In recent years, low cost and space saving have progressed for image forming apparatuses such as copier or printers using an electrophotographic system.

Thus, miniature image forming apparatuses have widespread use not only in offices but also in small offices and individuals to be used for small amounts and various kinds of printing such as fliers, advertisement, and catalogs. Meanwhile, for the image forming apparatus, there has been a high demand for not only high image quality but also countermeasures of a wide variety of sheets.

Of the wide variety of sheets, particularly highly demanded sheets are coated sheets of which flatness and appearance are improved by using high-quality sheets as bases and applying paints to the surfaces. For the coated sheets, there is gloss, smoothness is high, photos or letters can vividly be reproduced, and finish quality is high. Therefore, the coated sheets are suitable for fliers, advertisement, and catalogs.

However, when the coated sheets are left in a bundle form in an environment of high humidity, the outer-layer surfaces absorb moisture and the sheets are mutually adsorbed with ease. When the sheets are mutually adsorbed, a problem may easily occur such as double-feeding in which overlapping sheets are conveyed from a sheet feeding portion or sheet feed failure in which a sheet is not conveyed. Thus, for example, Japanese Patent Application Laid-open No. 11-157686 suggests a technology for handling sheets by blowing air to side and upper surfaces of the sheets stacked in a sheet stacking portion so that adsorption between sheets is suppressed.

However, since sheet smoothness of the coated sheets is high, the coated sheets tend to be mutually adsorbed due to an electrostatic force of the mutual overlapping coated sheets. In particular, in image forming apparatuses of an electrophotographic system, a high transfer voltage is applied to a sheet when a toner image is transferred to the sheet. However, when a high voltage is applied to a sheet, a transfer current flows in the sheet, and thus the sheet is charged.

Here, in image forming apparatuses of the related art, the rear end of a preceding sheet to which a toner image is transferred in a transfer portion comes into contact with the upper surface of a subsequent sheet stacked in a sheet stacking portion depending on the sizes of the sheets or the sizes of the image forming apparatuses in some cases. Further, the sheet stacking portion is grounded to the earth in some cases. In this case, when a resistance value of the sheet stacking portion is small or a resistance value of all of the stacked sheets becomes small with a decrease in a stacking amount, a potential difference between a charged preceding sheet and a subsequent sheet increases due to the fact that the sheet stacking portion is grounded to the earth. In the case of coated sheets, this state occurs considerably.

As a result, an electrostatic force occurs between the preceding sheet and the subsequent sheet, the sheets are mutually adsorbed, and thus double-feeding of the sheets occurs. Since the double-feeding normally occurs unless the subsequent sheet is separated by a sufficient distance during a transfer operation of the preceding sheet, the double-feeding may not be prevented from occurring by the above-described technology for handling sheets by blowing air.

By improving an insulation capability of a sheet stacking portion, the double-feeding by the electrostatic adsorption can be prevented. However, when the insulation capability of the sheet stacking portion is improved, charge is gradually accumulated in sheets stacked in the sheet stacking portion and members constituting the sheet stacking portion during continuous feeding of the sheets. When the accumulated charge exceeds a given threshold value, a problem occurs in some cases, for example, in that an electric component or the like in an image forming apparatus erroneously operates due to electrostatic noise.

Thus, in the image forming apparatuses of the related art, when a preceding sheet comes into contact with a subsequent sheet in a sheet stacking portion during a transfer operation and the sheet stacking portion is grounded to the earth due to the downsizing, the double-feeding occurs in some cases due to the electrostatic adsorption caused by a potential difference between the preceding sheet and the subsequent sheet. Further, when the sheet stacking portion is not earthed to the ground, charge is accumulated in the sheet stacking portion and the constituent elements. When the charge exceeds a threshold value, a problem occurs in some cases, for example, in that an electric component or the like in an image forming apparatus operates erroneously due to electrostatic noise.

SUMMARY OF THE INVENTION

According to an aspect of the invention, there is provided an image forming apparatus including a body including a containing portion, an image forming portion forming an image on a sheet, a sheet feeding portion feeding the sheet to the image forming portion, a sheet storing portion contained in the containing portion to be drawable and including a sheet stacking portion which is liftable and on which the sheet fed by the sheet feeding portion is stacked, a ground portion provided in the containing portion to be grounded, and a switching portion switching a state of the sheet stacking portion from an electrically insulated insulation state to a grounding state grounded through the ground portion in response to an operation of drawing the sheet storing portion contained in the containing portion.

Further features of the present invention will become apparent from the following description of exemplary embodiments with reference to the attached drawings.

DESCRIPTION OF THE EMBODIMENTS

Figure 1:
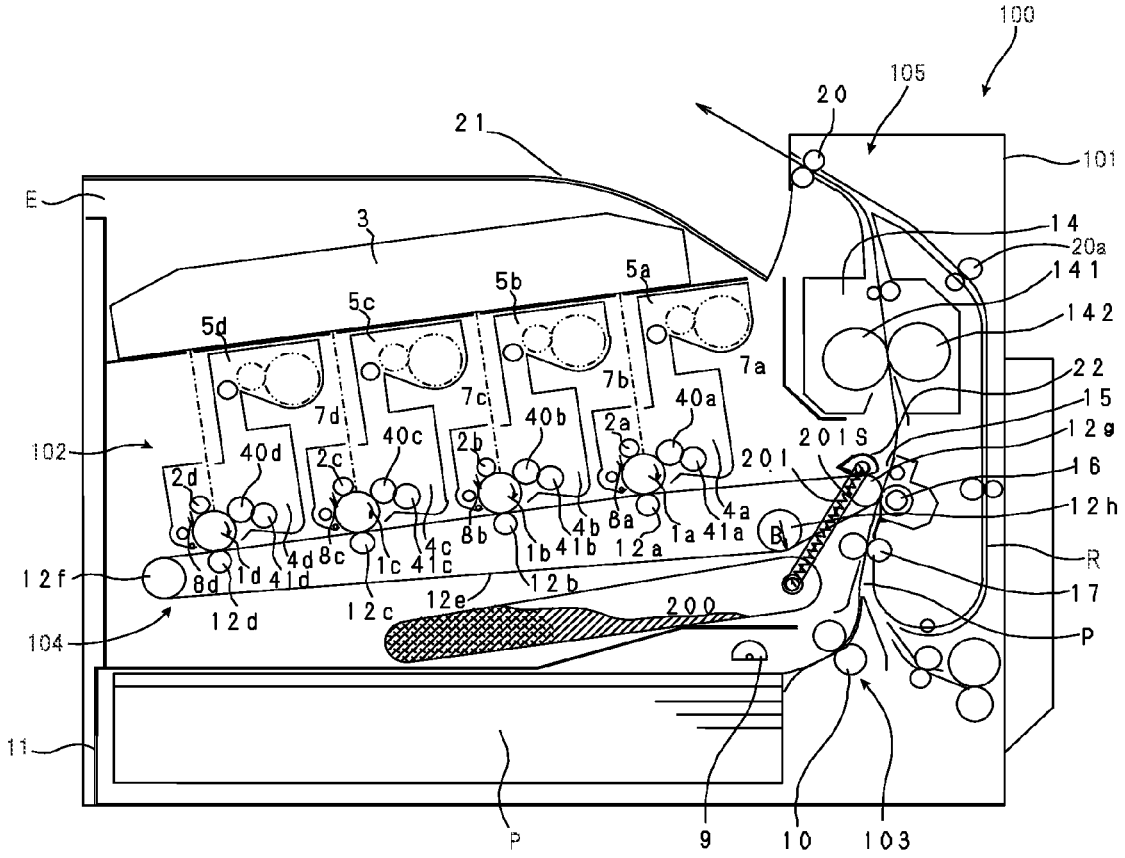
FIG. 1 is a diagram illustrating the entire configuration of a full-color laser printer which is an example of an image forming apparatus according to a first embodiment of the invention.

Hereinafter, a mode for carrying out the invention will be described in detail with reference to the drawings. FIG. 1 is a diagram illustrating the entire configuration of a full-color laser printer of an electrophotographic system which is an example of an image forming apparatus according to a first embodiment of the invention. In FIG. 1, reference numeral 100 denotes a full-color laser printer, and reference numeral 101 denotes a full-color laser printer body (hereinafter referred to as a printer body). In the printer body 101 which is an image forming apparatus body, an image forming portion 102 forming an image on a sheet, a sheet feed unit 103 feeding a sheet, and the like are provided.

The image forming portion 102 is detachably mounted on the printer body 101 and includes process cartridges 7 (7*a*, 7*b*, 7*c* and 7*d*) forming four color toner images of yellow, magenta, cyan, and black. The process cartridges 7 are configured to include developing units 4 (4*a*, 4*b*, 4*c*, and 4*d*) and toner units 5 (5*a*, 5*b*, 5*c*, and 5*d*).

The developing units 4 include photoconductive drums 1 (1*a*, 1*b*, 1*c*, and 1*d*) which are image bearing members, charging rollers 2 (2*a*, 2*b*, 2*c*, and 2*d*), and drum cleaning blades 8 (8*a*, 8*b*, 8*c*, and 8*d*). The developing units 4 further include developing rollers 40 (40*a*, 40*b*, 40*c*, and 40*d*) and developer application rollers 41 (41*a*, 41*b*, 41*c*, and 41*d*).

The image forming portion 102 includes a scanner unit 3 that is disposed above the process cartridges 7, radiates laser beams based on image information, and forms an electrostatic latent image on the photoconductive drums 1. The image forming portion 102 includes an intermediate transfer belt unit 104 including an intermediate transfer belt 12*e* which is disposed below the process cartridges 7 and to which respective color toner images on the photoconductive drums are sequentially transferred.

The intermediate transfer belt unit 104 includes the intermediate transfer belt 12*e* turning counterclockwise and primary transfer rollers 12*a*, 12*b*, 12*c*, and 12*d* disposed on the inside of the intermediate transfer belt 12*e*. The intermediate transfer belt 12*e* is extended around a drive roller 12*f*, a secondary transfer counter roller 12*g*, and a tension roller 12*h* and is configured such that a tensile strength is applied in a direction indicated by an arrow B by the tension roller 12*h*.

The primary transfer rollers 12*a*, 12*b*, 12*c*, and 12*d* are disposed to face the photoconductive drums 1, respectively, and a transfer bias is applied by a transfer bias application portion 161 which is a bias application portion illustrated in FIG. 3, as will be described below. By applying a primary transfer bias by the primary transfer rollers 12*a*, 12*b*, 12*c*, and 12*d*, the respective color toner images on the photoconductive drums are sequentially transferred to the intermediate transfer belt 12*e*, so that a full-color image is formed on the intermediate transfer belt. The sheet feed unit 103 includes a sheet feed cassette 11 (sheet storing portion) mounted on the printer body 101 to be drawable and a sheet feed roller 9 which is a sheet feeding portion feeding a sheet P accommodated in the sheet feed cassette 11.

In FIG. 1, reference numeral 16 denotes a secondary transfer roller that forms a secondary transfer portion 15, transferring the full-color toner image formed on the intermediate transfer belt 12*e* to a sheet, along with the secondary transfer counter roller 12*g*. Reference numeral 14 denotes a fixing portion fixing the toner image by heating and pressurizing the toner image transferred to the sheet by the secondary transfer portion 15. The fixing portion 14 includes a fixing roller 141 including a heater (not illustrated) therein and a pressurizing roller 142 coming into pressure contact with the fixing roller 141. Reference numeral 105 denotes a sheet discharge portion discharging the sheet to which the toner image is fixed by the fixing portion 14, to a discharged-sheet stacking portion 21 on the upper surface of the printer body. The sheet discharge portion 105 includes a pair of discharge rollers 20 rotated forward and reversely, a pair of switchback rollers 20*a*, and a reverse conveying path R.

Next, an image forming operation of the full-color laser printer 100 having the above-described configuration will be described. When an image signal is input from a PC (not illustrated) or the like to the scanner unit 3, a laser beam according to the image signal is radiated from the scanner unit 3 to the photoconductive drum. At this time, the surface of the photoconductive drum 1 is uniformly charged with predetermined polarity and potential by the charging roller 2, and thus an electrostatic latent image is formed on the surface thereof through the radiation of the laser beam from the scanner unit 3.

Thereafter, the electrostatic latent images are developed by the developing units 4, so that four color toner images of yellow, magenta, cyan, and black are formed on the photoconductive drums of the process cartridges 7. Then, the full-color toner image is formed on the intermediate transfer belt by sequentially transferring the four color toner images to the intermediate transfer belt by the primary transfer bias applied to the primary transfer rollers 12*a*, 12*b*, 12*c*, and 12*d*. After the toner images are transferred, the toner remaining on the surfaces of the photoconductive drums is removed by the drum cleaning blades 8.

Along with the toner image forming operation, the sheet P accommodated in the sheet feed cassette 11 is sent by the sheet feed roller 9, and then is separated one by one by a pair of separation rollers 10. The separated sheet P is conveyed to a pair of registration rollers 17. Next, the sheet P arrives at a timing by the pair of registration rollers 17, and then is conveyed to the secondary transfer portion 15.

Then, in the secondary transfer portion 15, the full-color toner image on the intermediate transfer belt is secondarily transferred to the conveyed sheet P by applying a bias of positive polarity to the secondary transfer roller 16. After the full-color toner image is secondarily transferred to the sheet P, the toner remaining on the intermediate transfer belt is removed by the intermediate transfer belt cleaning unit 22 and the removed toner passes through a waste toner conveyance passage 201 to be collected by a waste toner collecting container 200.

After the toner image is transferred, the sheet P is conveyed to the fixing portion 14 and is heated and pressurized by the fixing roller 141 and the pressurizing roller 142, so that the toner image is fixed to the surface thereof. Next, after the full-color toner image is fixed, the sheet P is discharged and stacked in the discharged-sheet stacking portion 21 by the pair of discharge rollers 20 provided in the sheet discharge portion 105. When images are formed on both surfaces of the sheet, the sheet P is conveyed to the pair of registration rollers 17 again through the reverse conveying path R by reversing of the pair of discharge rollers 20 and the pair of switchback rollers 20*a*. Thereafter, the sheet is conveyed to the secondary transfer portion 15 by the pair of registration rollers 17 and an image is formed on a second surface. Then, when the sheet P on which the image is formed on the second surface in this way passes through the fixing portion 14, the toner image is fixed. Thereafter, the sheet P is stacked on the discharged-sheet stacking portion 21 by the pair of discharge rollers 20.

Figure 2:
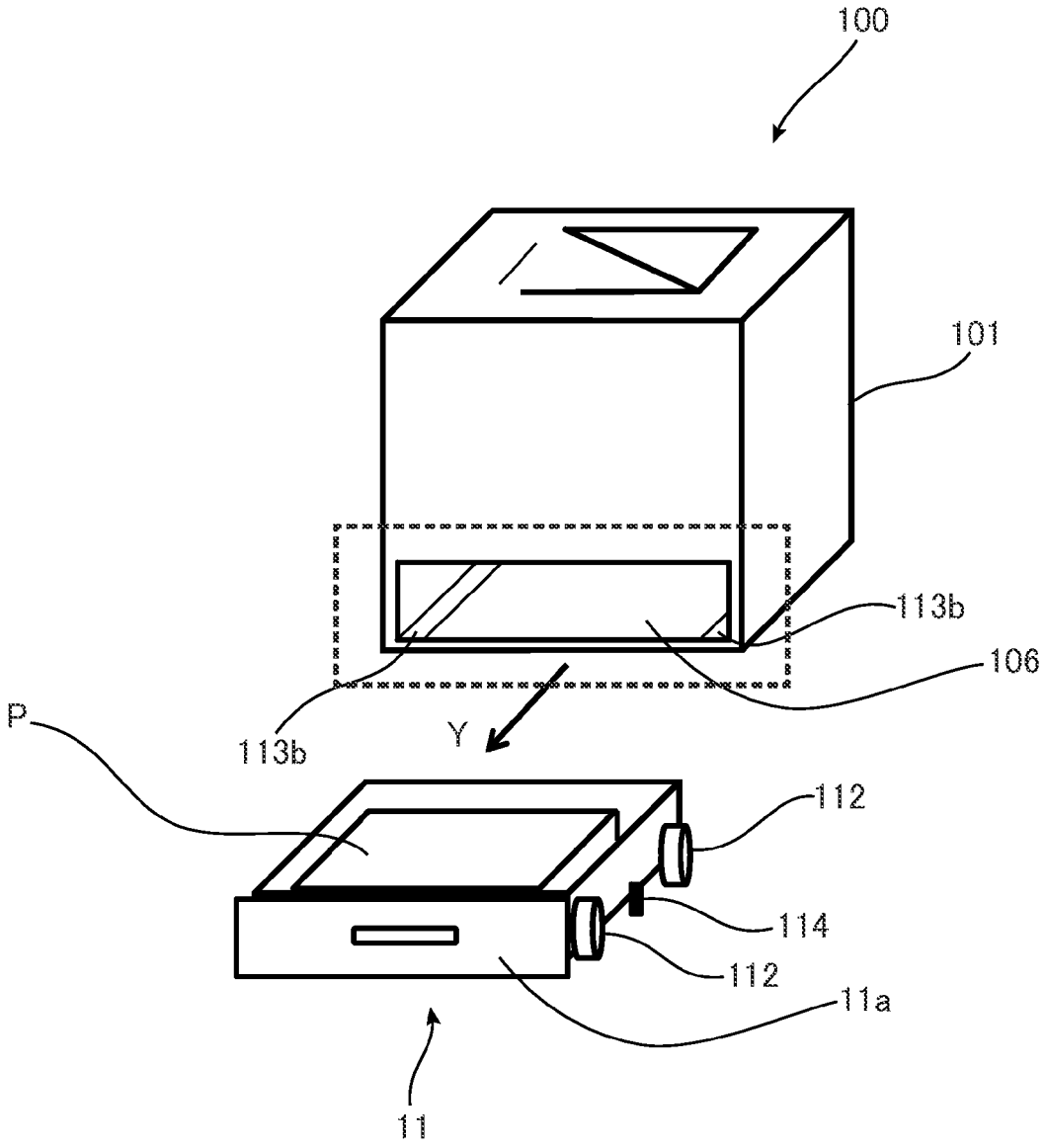
FIG. 2 is a diagram illustrating a state in which a sheet feed cassette is drawn from a sheet feed cassette accommodation portion provided in the body of the full-color laser printer.

Incidentally, in the embodiment, as illustrated in FIG. 2, the sheet feed cassette 11 which is a sheet accommodation unit is contained in a sheet feed cassette accommodation portion (containing portion or housing portion) 106, which is a containing portion provided in the lower part of the printer body 101, to be drawable. In FIG. 2, reference numeral 112 denotes a guide roller mounted on a cassette body 11*a* which is a sheet accommodation portion of the sheet feed cassette 11. The sheet feed cassette 11 is guided by the guide roller 112 and guide rails 113*a* and 113*b* illustrated in FIGS. 5A and 5*b*, as will be described below, to be contained in and drawn from the printer body 101.

Figure 3:
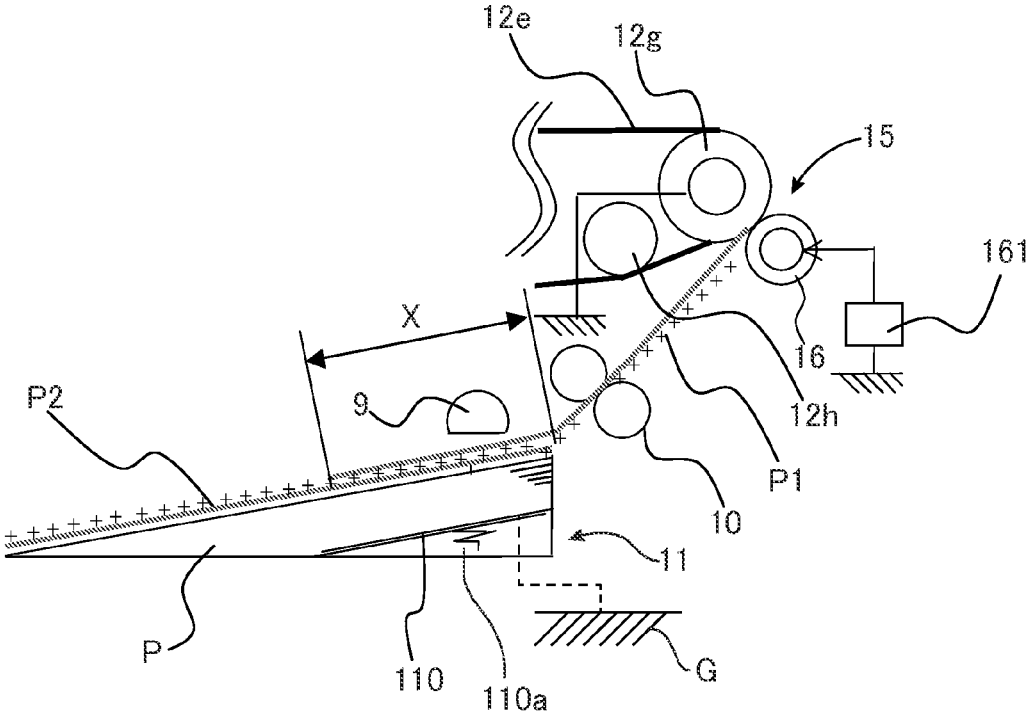
FIG. 3 is a first diagram for describing electrostatic adsorption of a preceding sheet and a subsequent sheet in the full-color laser printer.

In the cassette body 11*a* of the sheet feed cassette 11, as illustrated in FIG. 3, a sheet stacking plate 110 which is a sheet stacking portion on which the sheet P is stacked is supported to be turnable (liftable) in a vertical direction. In FIG. 3, reference numeral 110*a* denotes an urging spring urging the sheet stacking plate 110 upward and reference numeral 161 denotes a transfer bias application portion applying a transfer bias of positive polarity to the secondary transfer roller 16. In the related art, the sheet stacking plate 110 is earthed to a ground G, as indicated by a dashed line. The cassette body 11*a* is formed of a synthetic resin or the like which is a non-conductive material and the sheet stacking plate 110 is formed of a conductive synthetic resin or conductive metal. The urging spring 110*a* is formed of a metal spring material (conductive material).

Next, a mechanism in which multiple feeding occurs by electrostatic adsorption when a coated sheet is used as the sheet P will be described with reference to FIG. 3. A coated sheet has characteristics in which a resistance value is lower than that of a base sheet layer and conductivity is high since paints abounding with conductivity are applied to its outer-layer surface. Therefore, when a transfer bias with positive polarity is applied to the secondary transfer roller 16 by the transfer bias application portion 161 and the secondary transfer starts, positive charges are injected to a preceding sheet P1.

At this time, when an insulation capability of the pair of separation rollers 10, a conveyance guide (not illustrated), or the like coming into contact with the preceding sheet P1 during the secondary transfer is high, there is no way to escape the charge. Thus, the positive charge flows up to the rear end of the sheet and the entire sheet is charged. Further, when a conveyance distance from the sheet feed cassette 11 to the secondary transfer portion is short, the rear end of the preceding sheet P1 overlaps a subsequent sheet P2 by an overlap amount X during the secondary transfer of the preceding sheet P1 depending on a sheet size.

The overlap amount X becomes smaller and finally disappears as the preceding sheet P1 is gradually conveyed downstream. However, until the overlap amount X disappears, the charge flows in all of the sheets P stacked in the sheet feed cassette 11 due to the contact with the preceding sheet P1. Here, when a coated sheet is stacked in the sheet feed cassette 11, all of the stacked sheets are positively charged. When an amount of charge of the sheet becomes large, a surface potential of the sheet becomes higher.

Figure 4A:
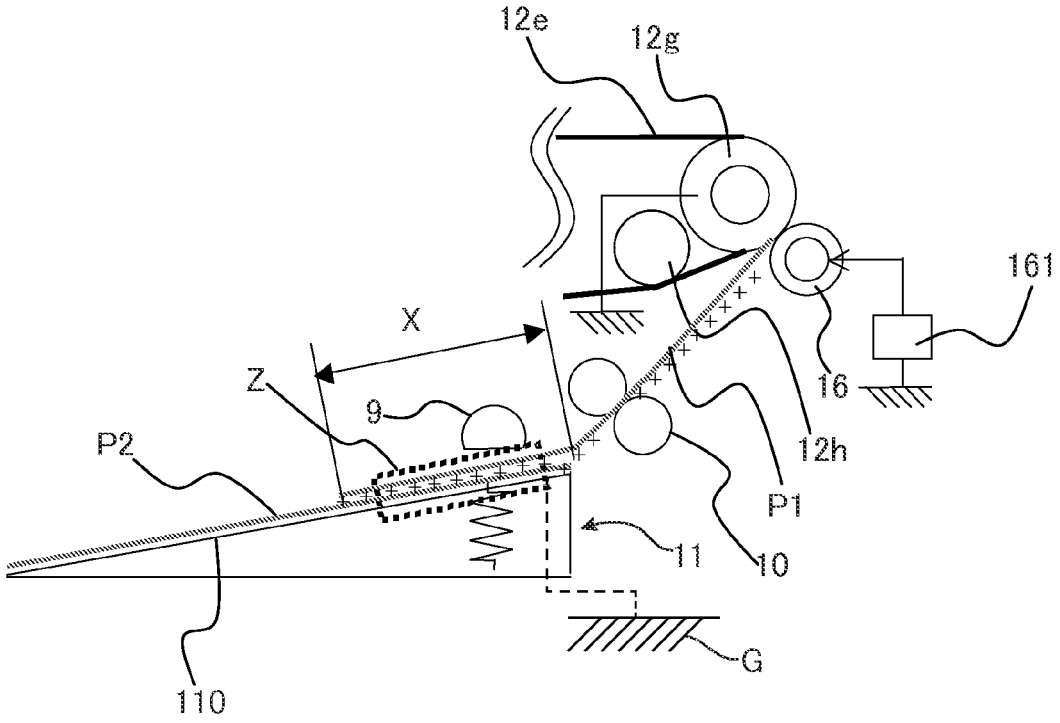
FIG. 4A is a second diagram for describing the electrostatic adsorption of a preceding sheet and a subsequent sheet in the full-color laser printer.

In this state, subsequently, when the sheets P are continuously fed, eventually, an amount of stacking of the sheets P is equal to or less than a predetermined amount or the sheets are charged until the amount of charge exceeds an electrostatic capacity, as illustrated in FIG. 4A. In this state, a phenomenon occurs in which the charge of the subsequent sheet P2 charged in the sheet feed cassette 11 starts flowing in the ground G from the sheet stacking plate 110 through the small number of stacked sheets P during the secondary transfer of the preceding sheet P1.

Figure 4B:
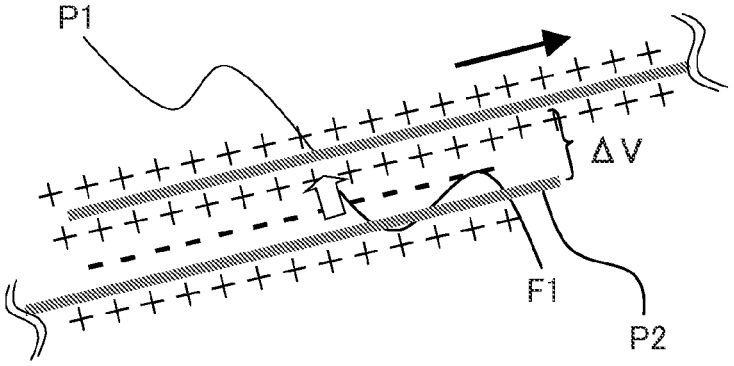
FIG. 4B is an expanded diagram illustrating a charge state of a preceding sheet and a subsequent sheet in a Z portion of FIG. 4A.

When the charge flows from the subsequent sheet P2 to the ground G in this way, the surface potential of the subsequent sheet P2 temporarily becomes zero. Hereupon, as illustrated in FIG. 4B which is an expanded view illustrating a charging state of the preceding sheet P1 and the subsequent sheet P2 in the Z portion of FIG. 4A, there occurs an induction phenomenon in which the upper surface of the subsequent sheet P2 on the side facing the preceding sheet P1 is negatively charged and the rear surface thereof is positively charged.

As a result, a potential difference $\Delta V$ occurs between the lower surface (positive polarity) of the preceding sheet P1 and the upper surface (negative polarity) of the subsequent sheet P2, and thus the subsequent sheet P2 is pulled and adsorbed to the preceding sheet P1 by a strong electrostatic force F1 to be conveyed, so that the preceding sheet P1 and the subsequent sheet P2 are multiply fed. Here, the electrostatic force F1 is proportional to the potential difference $\Delta V$.

As the amount of application of the transfer bias applied by the transfer bias application portion 161 is smaller, the amount of charge of the preceding sheet P1 is smaller and an amount of charge (surface potential) of the subsequent sheet P2 charged due to the contact with the preceding sheet P1 is accordingly smaller. Therefore, the potential difference $\Delta V$, which occurs in a situation in which the charge escapes from the subsequent sheet P2 due to the above-described reason, between the preceding sheet P1 and the subsequent sheet P2 is also smaller. As a result, since the electrostatic force F1 is also smaller and the electrostatic adsorption does not occur between the preceding sheet P1 and the subsequent sheet P2, the double-feeding can be avoided. That is, when the amount of application of the transfer bias is set to be small, the double-feeding can be avoided.

However, in a low-humidity environment, the surface resistance value of a coated sheet becomes higher. Therefore, when the amount of application of the transfer bias is small, transfer efficiency is lowered and a transfer failure may occur. In order to prevent the transfer failure, the amount of application of the transfer bias equal to or greater than a predetermined amount is necessary. When the sheets are continuously fed, as described above, the sheets are charged and the entire sheet feed cassette 11 is charged. When an amount of charge is equal to or greater than a given value, there is a concern that electrostatic noise occurs and an electric component (not illustrated) disposed in the image forming apparatus erroneously operates.

Figure 5A:
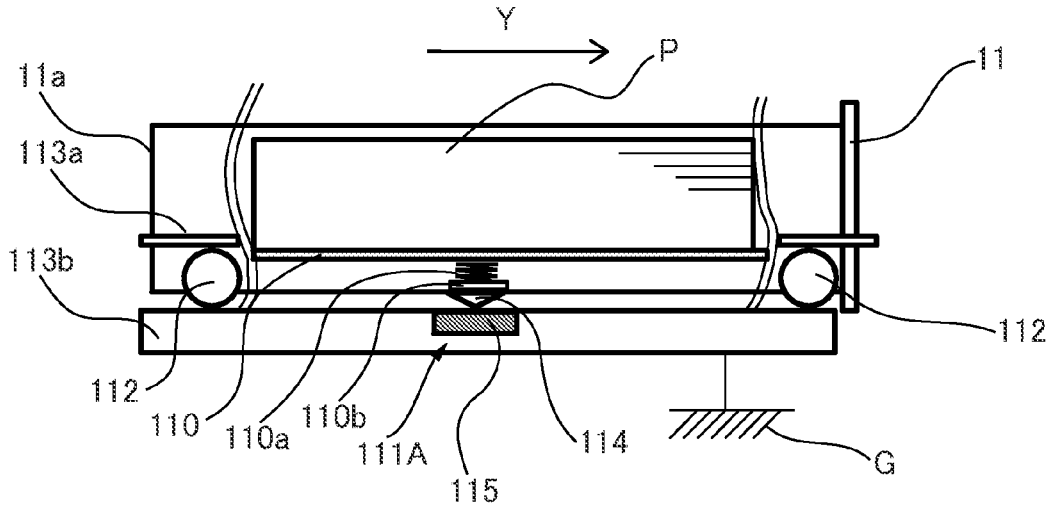
FIG. 5A is a diagram for describing a state in which the sheet feed cassette is accommodated in the sheet feed cassette accommodation portion.
Figure 5B:
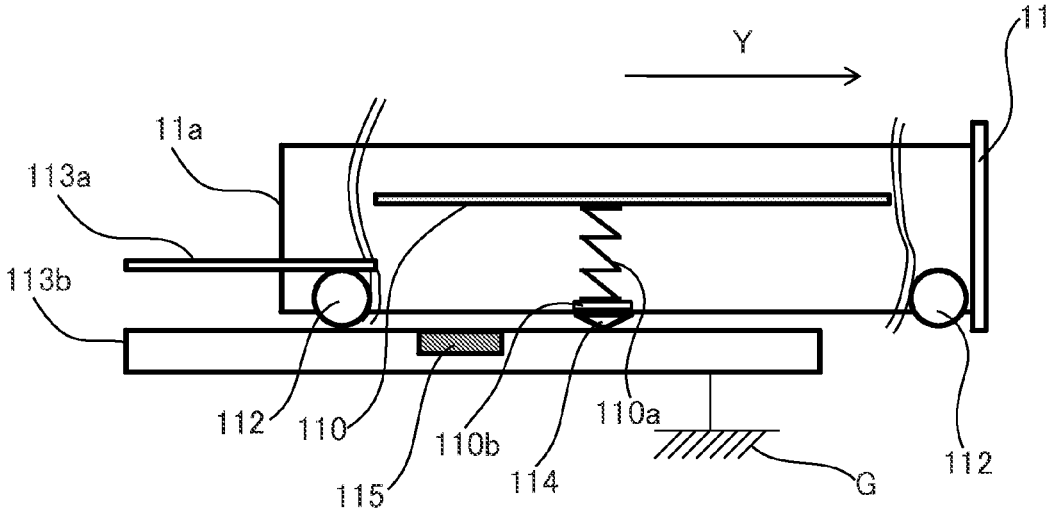
FIG. 5B is a diagram for describing a state in which the sheet feed cassette is drawn from the sheet feed cassette accommodation portion.

From this, it is necessary to prevent the electrostatic noise from occurring while maintaining an insulation state of the sheet feed cassette 11. Accordingly, in the embodiment, a ground contact point 114 which is a contact portion with the cassette body 11*a* is provided, as illustrated in FIGS. 5A and 5B. In FIGS. 5A and 5B, reference numeral 110*b* denotes a conductive plate with conductivity made of metal or the like, provided on the bottom surface of the cassette body 11*a* and coming into contact with the urging spring 110*a*. The sheet stacking plate 110 is connected to the ground contact point 114 via the conductive plate 110*b* and the urging spring 110*a*.

Of the pair of vertical guide rails 113*a* and 113*b* guiding the containing and the drawing of the sheet feed cassette 11, the lower guide rail 113*b* is earthed to the ground G. The lower guide rail 113*b* is formed of a conductive synthetic resin or metal. In a part of the upper surface of the guide rail 113*b*, there is provided an insulation sheet 115 which is an insulation portion coming into contact with the ground contact point 114 of the sheet stacking plate 110 when the sheet feed cassette 11 is accommodated.

By providing the insulation sheet 115, an insulation state can be achieved since the sheet stacking plate 110 comes into contact with the insulation sheet 115 of the rail upper surface via the ground contact point 114 when the sheet feed cassette 11 is accommodated in the printer body 101. Thus, during an image forming operation of the full-color laser printer 100, the sheets P are fed in the insulation state of the sheet stacking plate 110.

Thereafter, when the image forming operation is continuously performed on the sheets, as described above, the sheets P in the sheet feed cassette 11 and the sheet stacking plate 110 are gradually charged by the transfer bias current received by the sheets P from the secondary transfer portion 15. Even after all of the sheets are fed from the sheet feed cassette 11, the charge state is continuously maintained in the sheet stacking plate 110 due to the fact that the ground contact point 114 comes into contact with the insulation sheet 115. For this reason, there is a concern that the entire sheet feed cassette 11 is charged, the electrostatic noise occurs, and an electric component (not illustrated) disposed in the image forming apparatus erroneously operates.

Accordingly, when the sheets are supplemented in the sheet feed cassette 11 from which all of the sheets have been fed, a user draws the sheet feed cassette 11 from the printer body 101 in a direction indicated by an arrow Y in the drawing. At this time, as illustrated in FIG. 5B, the ground contact point 114 of the sheet stacking plate 110 becomes distant from the insulation sheet 115 on the guide rail 113*b* to come into contact with the guide rail 113*b*. Thus, the sheet stacking plate 110 is grounded so that the charge of the sheets flows in the ground G. In the embodiment, a switching portion 111A switching the sheet stacking plate 110 between the insulation state and the grounding state is formed by the ground contact point 114, the insulation sheet 115, and the like.

In the embodiment, as described above, the switching portion 111A allows the sheet stacking plate 110 to enter the electric insulation state when the sheet feed cassette 11 is contained and to enter the grounding state via the guide rail 113*b* when the sheet feed cassette 11 is drawn. That is, while the sheet feed cassette 11 is drawn from the sheet feed cassette accommodation portion 106, a grounding route is formed by the sheet stacking plate 110, the urging spring 110*a*, the conductive plate 110*b*, the ground contact point 114, and the guide rail 113*b*. The charge of the sheets stacked on the sheet stacking plate 110 can be allowed to flow in the ground G via the grounding route.

In this configuration, the electrostatic noise causing an erroneous operation of the full-color laser printer 100 can be prevented from occurring. Further, since the relative difference of the surface potential of the sheets mutually overlapping during the transfer can be reduced, the double-feeding and the feed failure caused by the electrostatic adsorption of coated sheets can be reliably prevented. That is, in the above-described configuration, since the double-feeding and the electrostatic noise can be prevented from occurring, it is possible to provide an image forming apparatus such as the high-quality full-color laser printer 100 in which the feed failure is small and an operation is stable.

In the embodiment, the urging spring 110*a* is connected to the conductive plate 110*b* and the ground contact point 114 is connected to the sheet stacking plate 110, but the invention is not limited thereto. For example, a dedicated spring may be provided in the sheet stacking plate 110 and this spring may be connected to the conductive plate 110*b* so that the ground contact point 114 is connected to the sheet stacking plate 110.

Figure 6A:
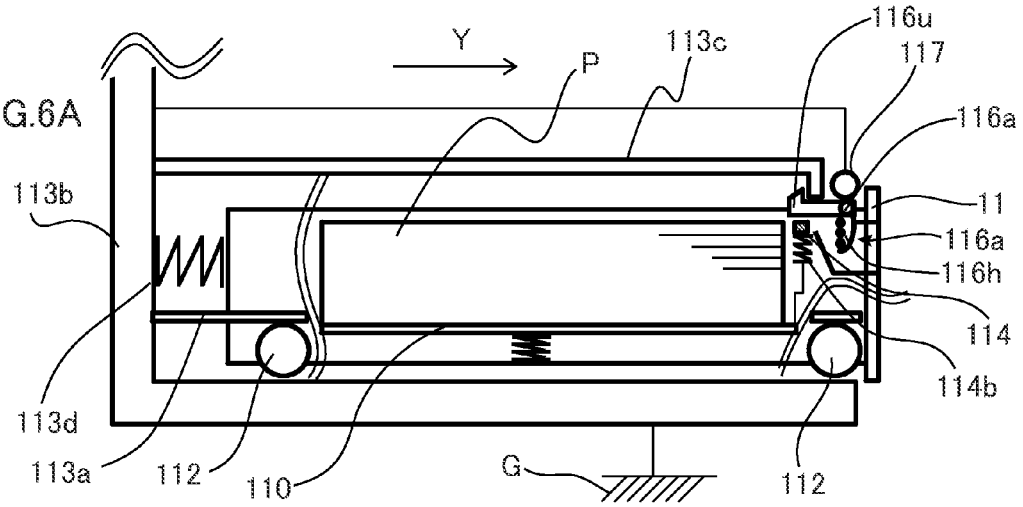
FIG. 6A is a diagram for describing the configuration of a sheet feed cassette accommodation portion and a sheet feed cassette of a full-color laser printer which is an example of an image forming apparatus according to a second embodiment of the invention.
Figure 6B:
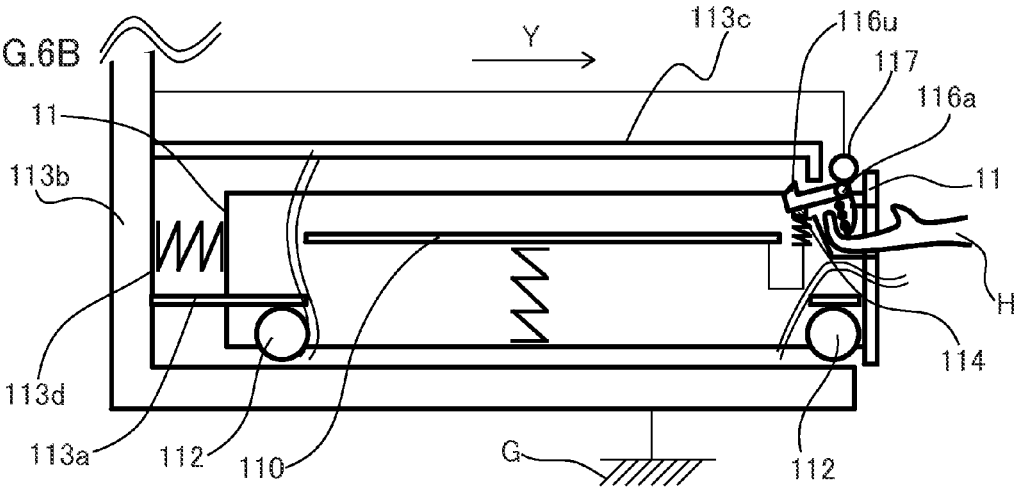
FIG. 6B is a diagram for describing a state in which the sheet feed cassette in FIG. 6A is drawn from the sheet feed cassette accommodation portion.
Figure 6C:
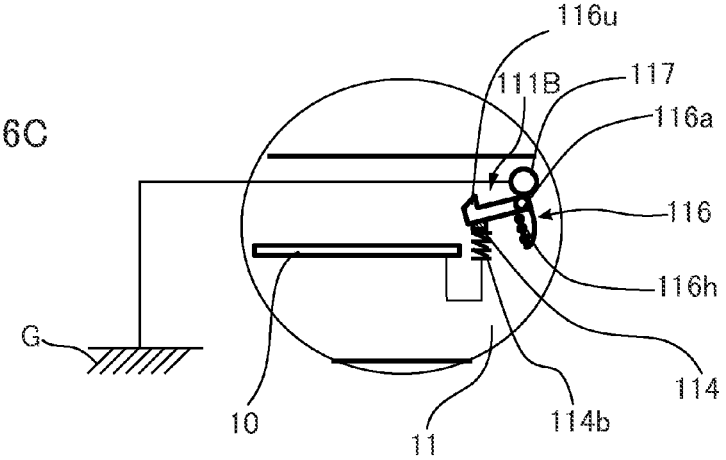
FIG. 6C is an expanded diagram illustrating a cassette latch state in FIG. 6B.

Next, a second embodiment of the invention will be described. FIGS. 6A to 6C are diagrams for describing the configuration of the sheet feed cassette accommodation portion and a sheet feed cassette of a full-color laser printer which is an example of an image forming apparatus according to the second embodiment of the invention. In FIGS. 6A to 6C, the same reference numerals as those described in FIGS. 5A and 5B indicate the same or corresponding portions.

In FIGS. 6A to 6C, reference numeral 113*c* denotes a cassette fixing plate provided in a printer body 101. Reference numeral 116 denotes a cassette latch that is held by a sheet feed cassette 11 to be turnable about a turning center 116*a* and is configured to engage/disengage with/from the cassette fixing plate 113*c*. The sheet feed cassette 11 is locked to the printer body 101 by the latch 116 engaging with the cassette fixing plate 113*c*. The cassette latch 116 includes a latch upper portion 116*u* that is locked in the cassette fixing plate 113*c* to be unlockable and has conductivity and a latch access portion 116*h* that is operated by a user. The cassette latch 116 is urged by a spring (not illustrated) in a direction in which the latch upper portion 116*u* is locked in the cassette fixing plate 113*c*. The cassette latch 116 and the cassette fixing plate 113*c* form a lock portion that locks the sheet feed cassette 11 so that the sheet feed cassette 11 is mounted on a sheet feed cassette accommodation portion 106.

FIG. 6A illustrates a state in which the sheet feed cassette 11 is accommodated in the printer body 101 when sheets P are sufficiently stacked. In FIG. 6A, reference numeral 113*d* denotes a cassette pushing spring that presses the sheet feed cassette 11 in a direction indicated by an arrow Y and opposite to the mounting direction.

The sheet feed cassette 11 accommodated in the printer body 101 is fixed to the printer body 101 by engaging the front end of the latch upper portion 116*u* with the cassette fixing plate 113*c* and pressing the sheet feed cassette 11 in the direction indicated by the arrow Y by the cassette pushing spring 113*d*.

In the embodiment, a sheet stacking plate 110 includes a ground contact point 114 movable in the vertical direction. A guide rail 113*b* of the printer body 101 is earthed to the ground and the printer body 101 includes a latch contact point 117 which is a conductive portion coming into contact with the latch upper portion 116*u* with conductivity and earthed to the ground via the guide rail 113*b*. As in the first embodiment, the cassette body 11*a* is formed of a synthetic resin or the like with non-conductivity and the sheet stacking plate 110 is formed of a conductive synthetic resin or conductive metal. The guide rail 113*b* is also formed of a conductive synthetic resin or conductive metal.

The ground contact point 114 is urged upward by the spring 114*b* and is supported by a stopper (not illustrated) at a position at which the ground contact point 114 does not come into contact with the latch contact point 117 when the sheet feed cassette 11 illustrated in FIG. 6A is mounted. Thus, when the sheet feed cassette 11 is accommodated in the printer body 101, the sheet feed cassette 11 is in an insulation state. Even when the sheet is fed, this insulation state is maintained.

On the other hand, when an image forming operation is continuously performed on the sheets, as described above, the sheets P in the sheet feed cassette 11 and the sheet stacking plate 110 are charged by the transfer bias current flowing in the preceding sheet P1 from the secondary transfer portion. Even after all of the sheets are sent from the sheet feed cassette 11, the sheet feed cassette 11 is still in the insulation state. Thus, the sheet stacking plate 110 is continuously maintained in the charge state. For this reason, there is a concern that the entire sheet feed cassette 11 is charged, the electrostatic noise occurs, and an electric component (not illustrated) disposed in the image forming apparatus erroneously operates.

Accordingly, when all of the sheets are sent from the sheet feed cassette 11, the user draws the sheet feed cassette 11 from the printer body 101 in a direction indicated by an arrow Y in the drawing to supplement the sheets in the sheet feed cassette 11. At this time, as illustrated in FIG. 6B, the user applies his or her hand H to the latch access portion 116*h* and turns the cassette latch 116 counterclockwise about the turning center 116*a* to release the fixing of the sheet feed cassette 11.

Thus, the latch upper portion 116*u* is moved from the lock position and is moved to a lock releasing position at which the locking of the latch upper portion 116*u* in the cassette fixing plate 113*c* is released, and the sheet feed cassette 11 is pushed in the direction indicated by the arrow Y in the drawing by the cassette pushing spring 113*d*. When the latch upper portion 116*u* is moved downward by a lock releasing operation on the cassette latch 116, the latch upper portion 116*u* comes into contact with the ground contact point 114 connected to the sheet stacking plate 110.

Thus, the sheet stacking plate 110 and the latch contact point 117 earthed to the ground via the guide rail 113*b* are connected to each other. As illustrated in FIG. 6C, the sheet stacking plate 110 and the ground G become a closed loop and the charge of the sheet stacking plate 110 is opened. That is, in the embodiment, a switching portion 111B is formed by the latch contact point 117, the ground contact point 114, and the cassette latch 116 which is a connection portion.

In the embodiment, as described above, when the locking by the cassette latch 116 is released and the sheet feed cassette 11 is drawn from the printer body 101, the latch contact point 117 and the ground contact point 114 are connected to each other by the cassette latch 116. That is, when the latch access portion 116*h* is pulled by the user to draw the sheet feed cassette 11 from the sheet feed cassette accommodation portion 106, a grounding route is formed by the sheet stacking plate 110, the ground contact point 114, the latch upper portion 116*u*, the latch contact point 117, and the guide rail 113*b*. The charge of the sheets stacked on the sheet stacking plate 110 can be allowed to flow in the ground G via the grounding route. Thus, the sheet stacking plate 110 enters the grounding state via the guide rail 113*b* and the charge of the sheet stacking plate 110 accordingly disappears. As a result, the same advantages as those of the above-described first embodiment can be obtained.

The cases in which the sheet feed cassette 11 is contained in the printer body have been described above, but the invention is not limited thereto. For example, even when the sheet feed cassette 11 partially protrudes from the printer body, the same configuration can be applied in a configuration in which the sheet stacking plate and the ground have the same potential by a user's action or an operation performed to supplement sheets additionally.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-146647, filed Jul. 12, 2013 which is hereby incorporated by reference herein in its entirety.

What is claimed is:

1. An image forming apparatus comprising:

a body including a containing portion;

an image forming portion forming an image on a sheet;

a sheet feeding portion feeding the sheet to the image forming portion;

a sheet storing portion contained in the containing portion, configured to be drawable and including a sheet stacking portion which is liftable and on which the sheet fed by the sheet feeding portion is stacked;

a ground portion, provided in the containing portion, that is electrically grounded; and a switching portion switching a state of the sheet stacking portion from an electrically insulated state to an electrically grounded state grounded through the ground portion in response to an operation of drawing the sheet storing portion contained in the containing portion.

2. The image forming apparatus according to claim 1, wherein the switching portion includes:

a conductive contact portion connected to the sheet stacking portion; and an insulation portion provided in the ground portion, contacting the contact portion to insulate the contact portion from the ground portion when the sheet storing portion is contained, and releasing the contact with the contact portion such that the contact portion comes into contact with the ground portion when the sheet storing portion is drawn.

3. The image forming apparatus according to claim 2, further comprising a conductive spring connecting the contact portion with the sheet stacking portion.

4. The image forming apparatus according to claim 2, wherein the sheet storing portion is formed of a non-conductive material to make the sheet stacking portion into the insulation state when the sheet storing portion is contained in the containing portion.

5. The image forming apparatus according to claim 1, wherein the switching portion includes:

a contact portion which is connected to the sheet stacking portion and has conductivity;

a conductive portion which is connected to the ground portion and has conductivity; and a connection portion which is provided in the sheet storing portion, does not connect the contact portion to the conductive portion when the sheet storing portion is contained in the containing portion, and connects the contact portion to the conductive portion when the sheet storing portion is drawn.

6. The image forming apparatus according to claim 5, wherein the connection portion is a lock portion that locks the sheet storing portion when the sheet storing portion is contained in the containing portion, does not connect the contact portion to the conductive portion when the connection portion is located at a position at which the sheet storing portion is locked, and connects the contact portion to the conductive portion by performing an operation of releasing a locking of the sheet storing portion when the sheet storing portion is drawn.

7. The image forming apparatus according to claim 6, wherein the lock portion includes a fixing plate provided in the containing portion and a conductive latch provided in the sheet storing portion and connected to the sheet storing portion, the sheet storing portion is locked in the containing portion by engaging the latch with the fixing plate, and the latch is brought into contact with the conductive portion through an operation performed on the latch to release the locking by the lock portion so that the sheet stacking portion enters the electrically grounded state through the ground portion.

8. The image forming apparatus according to claim 1, wherein the ground portion is a conductive guide portion which is provided in the containing portion and guides the drawing of the sheet storing portion.

* * * * *